US009774104B2

(12) United States Patent
Kitagawa

(10) Patent No.: US 9,774,104 B2
(45) Date of Patent: Sep. 26, 2017

(54) GROUND CONNECTION STRUCTURE AND GROUND TERMINAL FITTING

(71) Applicant: Sumitomo Wiring Systems, Ltd., Yokkaichi, Mie (JP)

(72) Inventor: Yuji Kitagawa, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/403,349

(22) Filed: Jan. 11, 2017

(65) Prior Publication Data

US 2017/0222336 A1 Aug. 3, 2017

(30) Foreign Application Priority Data

Feb. 3, 2016 (JP) ..... 2016-018766

(51) Int. Cl.
*H01R 4/48* (2006.01)
*H01R 4/34* (2006.01)

(52) U.S. Cl.
CPC ..... *H01R 4/48* (2013.01); *H01R 4/34* (2013.01)

(58) Field of Classification Search
CPC ..... H01R 4/48; H01R 4/34; H01R 4/4818; H01R 11/11; H01R 11/12
See application file for complete search history.

(56) References Cited

U.S. PATENT DOCUMENTS

| | | | | |
|---|---|---|---|---|
| 3,176,808 A * | 4/1965 | Matthews | A01B 15/02 | 403/408.1 |
| 3,329,190 A * | 7/1967 | Oldenkott | F16B 39/24 | 411/136 |
| 6,250,975 B1 * | 6/2001 | LaPointe | H01R 11/12 | 439/883 |
| 6,939,097 B2 * | 9/2005 | Carr | F16B 43/00 | 411/155 |
| 7,056,161 B2 * | 6/2006 | Delcourt | H01R 4/30 | 174/51 |
| 7,892,049 B1 * | 2/2011 | Andler | H01R 4/34 | 439/801 |

FOREIGN PATENT DOCUMENTS

| | | |
|---|---|---|
| CN | 104466460 | 3/2015 |
| JP | 2015-60687 | 3/2015 |

* cited by examiner

*Primary Examiner* — Harshad Patel
(74) *Attorney, Agent, or Firm* — Gerald E. Hespos; Michael J. Porco; Matthew T. Hespos

(57) ABSTRACT

A ground connection structure includes a stud bolt (11) standing on a ground surface (10A), and a non-circular rotation stopping portion (12) is formed on a base part of the stud bolt (11). A ground terminal fitting (20) is to be connected conductively to the ground surface (10). The ground terminal fitting (20) has a non-circular rotation stopping hole (25) that is fit to the rotation stopping portion (12) with relative rotation restricted. Resilient contact pieces (27) extend in an axial direction of the stud bolt (11) from an edge of the rotation stopping hole (25). A nut (15) is screwed onto the stud bolt (11) and causes the resilient contact pieces (27) to be deflected resiliently between the nut (15) and the ground surface (10).

12 Claims, 3 Drawing Sheets

GROUND CONNECTION STRUCTURE AND GROUND TERMINAL FITTING

BACKGROUND

1. Field of the Invention

The invention relates to a ground connection structure and a ground terminal fitting.

2. Description of the Related Art

Japanese Unexamined Patent Publication No. 2015-060687 discloses a connection structure with a body and a stud bolt standing on the body. A non-circular rotation stopping portion is formed on a base part of the stud bolt, and a bolt hole of a ground terminal fitting is fit to the rotation stopping portion. The ground terminal fitting is sandwiched between the body and a nut that is engaged threadedly with the stud bolt.

The nut brings the underside of the ground terminal fitting into contact with the body by pressing the surface of the ground terminal fitting. However, contact between the nut and the ground terminal fitting and contact between the ground terminal fitting and the body may be unstable if a height of the rotation stopping portion is equal to a plate thickness of the ground terminal fitting.

The invention was completed based on the above situation and aims to improve contact reliability.

SUMMARY

The invention relates to a ground connection structure with a stud bolt standing on a ground surface. A non-circular rotation stopping portion is formed on a base part of the stud bolt, and a ground terminal fitting is to be connected conductively to the ground surface. A non-circular rotation stopping hole is formed in the ground terminal fitting and is fit to the rotation stopping portion with relative rotation restricted. A resilient contact piece extends in an axial direction of the stud bolt from an edge of the rotation stopping hole. A nut is screwed onto the stud bolt and resiliently deflects the resilient contact piece between the nut and the ground surface.

The invention also relates to a ground terminal fitting conductively connectable to a ground surface on which a stud bolt stands. The ground terminal fitting includes a non-circular rotation stopping hole to be fitted to a non-circular rotation stopping portion formed on a base part of the stud bolt so that relative rotation is restricted. A resilient contact piece extends in an axial direction of the stud bolt from an edge of the rotation stopping hole and is deflected resiliently between a nut screwed onto the stud bolt and the ground surface.

The resilient contact piece is deflected resiliently between the nut and the ground surface when the nut is screwed onto the stud bolt. Thus, the ground terminal fitting and the ground surface reliably become conductive due to a resilient restoring force of the resilient contact piece. Further, the resilient contact piece extends from an opening edge of the rotation stopping hole, which is essential for connection to the ground surface. Thus, a terminal body need not be formed with an additional opening due to the formation of the resilient contact piece.

The resilient contact piece may project toward the ground surface. According to this configuration, the rotating nut does not contact the resilient contact piece when being screwed onto the stud bolt. Thus, the resilient contact piece will not be deformed improperly.

The ground connection structure may further include a projection formed in a contact area of the resilient contact piece with the ground surface. The projection may be configured to bite into the ground surface. According to this configuration, the projection bites into the ground surface to improve the reliability of contact between the ground terminal fitting and the ground surface.

The resilient contact piece may be configured for resiliently contacting an outer periphery of the rotation stopping portion. Thus, a contact area between the ground terminal fitting and the ground surface is enlarged by a contact area of the resilient contact piece and the outer periphery of the rotation stopping portion, thereby improving the reliability of the grounding performance.

DETAILED DESCRIPTION

Figure 1:
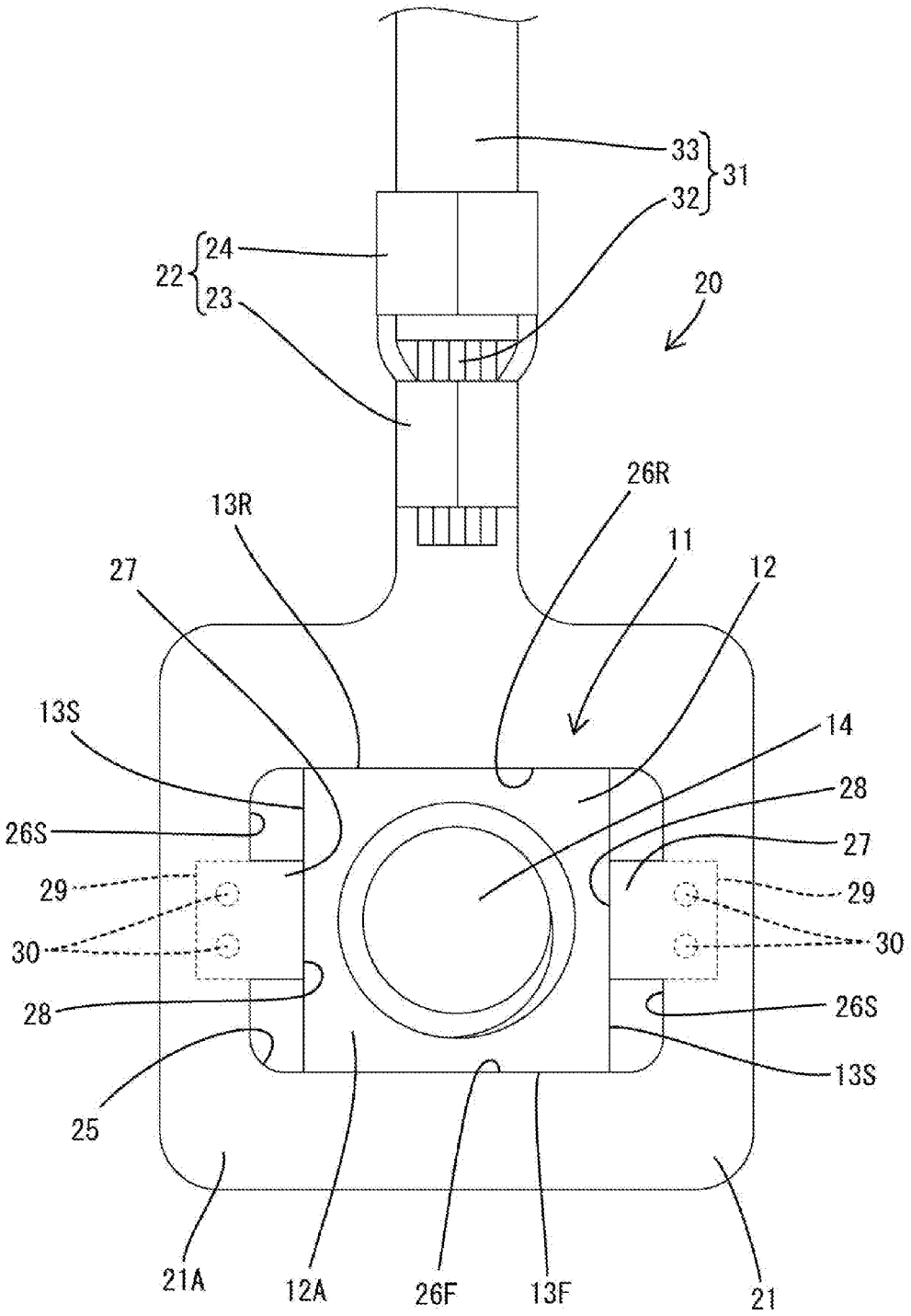
FIG. 1 is a plan view showing a state where a ground terminal fitting is fit to a rotation stopping portion in a ground connection structure of one embodiment.
Figure 2:
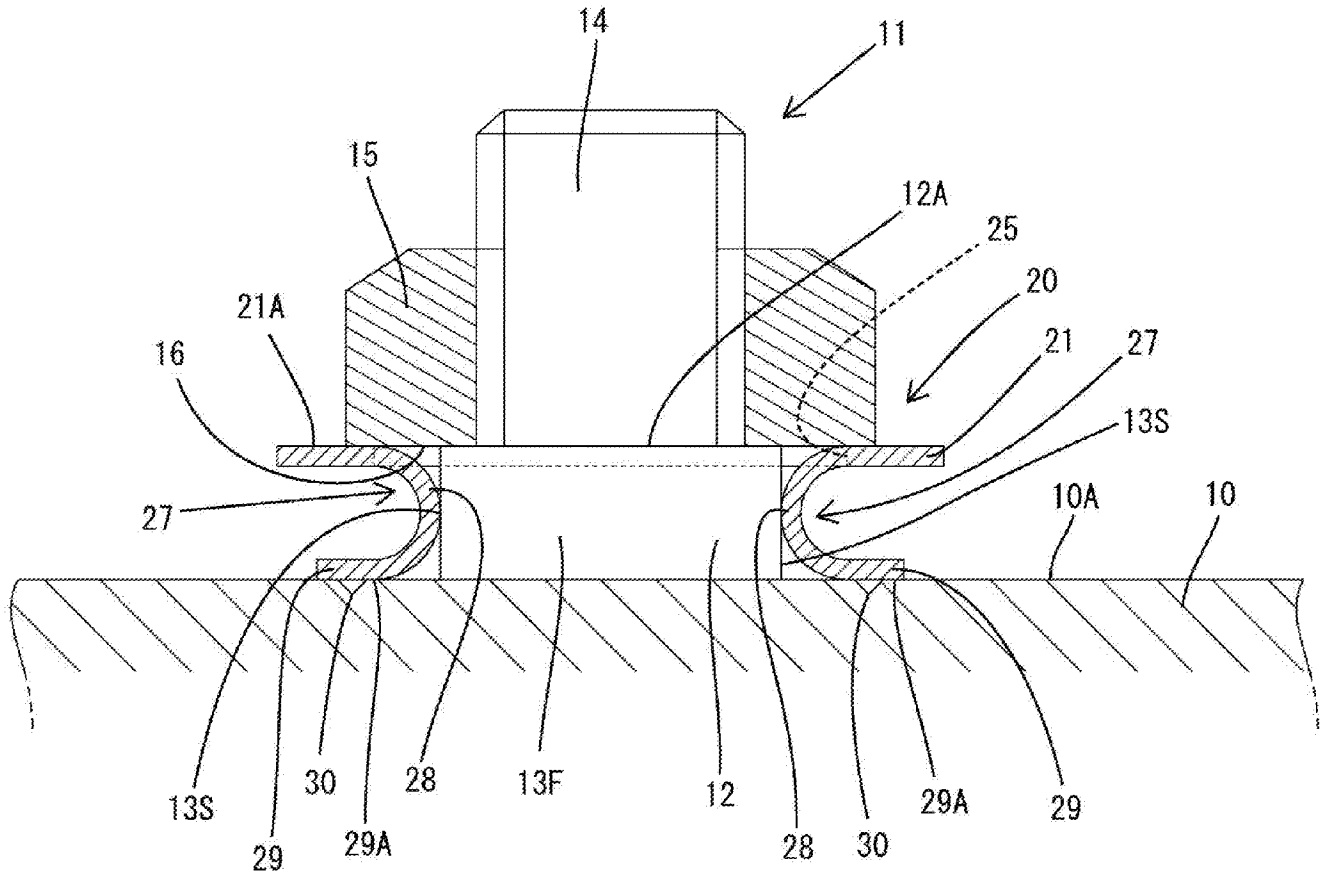
FIG. 2 is a section showing a state where the ground terminal fitting is connected to a ground surface.
Figure 3:
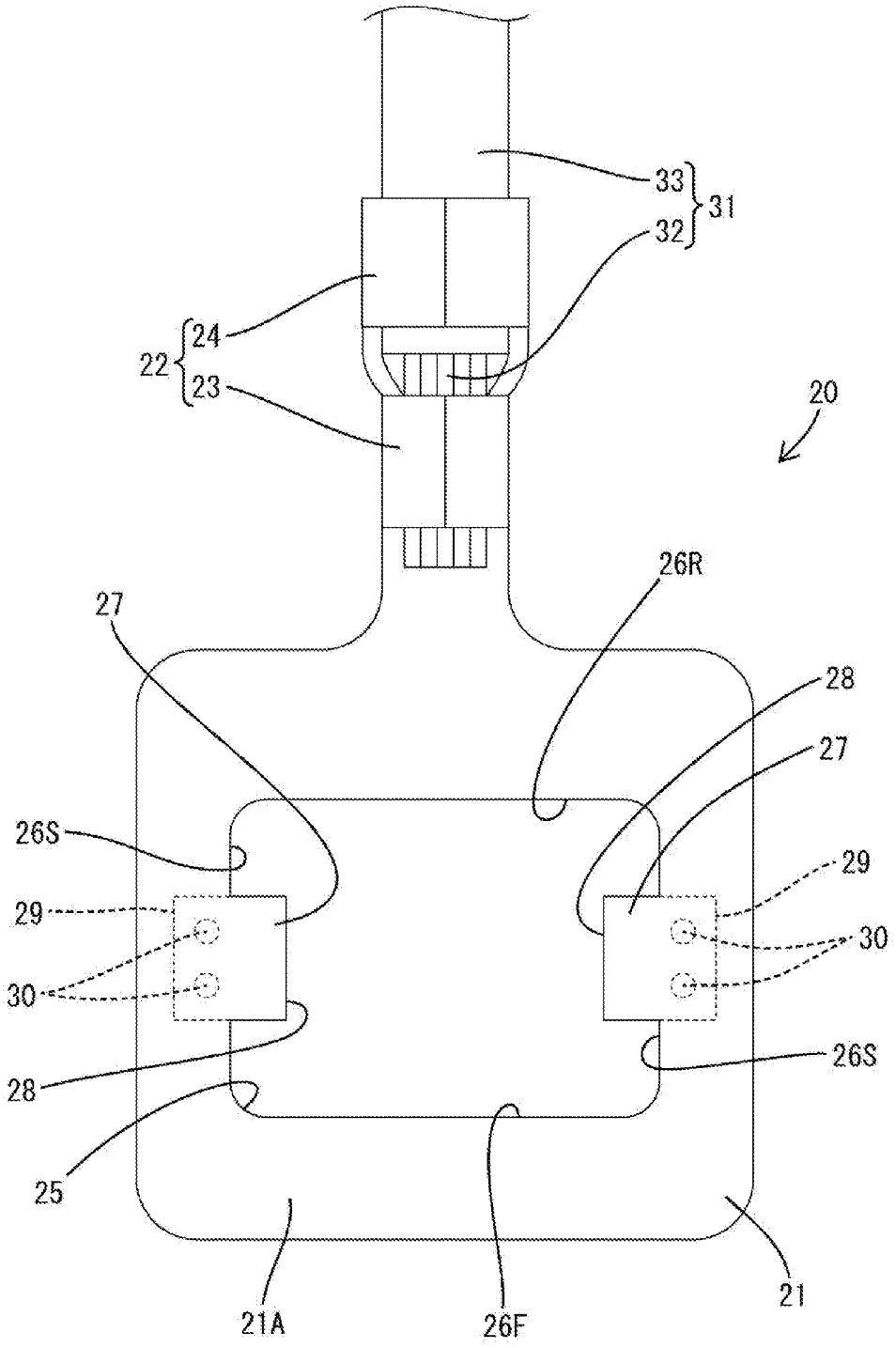
FIG. 3 is a plan view of the ground terminal fitting.

One specific embodiment of the invention is described with reference to FIGS. 1 to 3. It should be noted that, in the following description, a lower side in FIGS. 1 and 3 is defined as a front concerning a front-back direction. Upper and lower sides in FIG. 2 are defined as upper and lower sides concerning a vertical direction. Left and right sides in FIGS. 1 to 3 are defined as left and right sides concerning a lateral direction.

A ground connection structure of this embodiment includes a stud bolt 11 standing on a ground surface 10, a nut 15 to be screwed onto the stud bolt 11 and a ground terminal fitting 20 to be connected to the ground 10. The ground 10 constitutes a body of an automotive vehicle or the like. In this embodiment, the ground 10 is assumed to have a horizontal and upward facing flat ground surface 10A for the sake of convenience.

The stud bolt 11 is fixed to the upper surface 10A of the ground 10 such as by welding to project substantially perpendicularly up from the ground surface 10A. The stud bolt 11 and the ground 10 are connected conductively. A rotation stopping portion 12 is formed on a base part of the stud bolt 11 directly connected to the upper surface 10A of the ground 10 and has a square shape in a plan view (shape viewed parallel to an axis of the stud bolt 11). The outer peripheral surface of the rotation stopping portion 12 includes a front surface 13F, a rear surface 13R and left and right side surfaces 13S standing perpendicularly up from the ground surface 10A.

The stud bolt 11 has an externally threaded portion 14 projecting up from an upper surface 12A of the rotation stopping portion 12 with an axis oriented perpendicular to the ground surface 10A. An outer diameter of the externally threaded portion 14 is smaller than dimensions of the rotation stopping portion 12 in the front-back direction and lateral direction. A center of the rotation stopping portion 12 and an axial center of the externally threaded portion 14 are arranged to coincide in a plan view. The nut 15 is screwed onto the externally threaded portion 14 and has a flat seating surface 16 facing down.

The ground terminal fitting 20 is formed by applying bending and the like to a metal plate material of a predetermined shape having a thickness smaller than a height of the rotation stopping portion 12. The ground terminal fitting 20 is a single component including a terminal body 21, a crimping portion 22 and resilient contact pieces 27. The terminal body 21 is in the form of a flat plate having a substantially square shape in a plan view and substantially parallel to the ground surface 10A in a state connected to the ground surface 10A.

The crimping portion 22 extends back from the rear end edge of the terminal body 21. The crimping portion 22 is composed of a wire barrel 23 and an insulation barrel 24 connected to and behind the wire barrel 23. The wire barrel 23 is crimped conductively to a core 32 exposed in a front end part of a coated wire 31. The insulation barrel 24 is crimped to an insulation coating 33 in the front end part of the coated wire 31.

A rotation stopping hole 25 penetrates through a center of the terminal body 21 in a plate thickness direction and has a square shape in a plan view. An interval in the front-back direction between a front edge part 26F and a rear edge part 26R of an opening area of the rotation stopping hole 25 is equal to or slightly larger than the dimension of the rotation stopping portion 12 in the front-back direction. An interval in the lateral direction between left and right side edges 26S of the opening area of the rotation stopping hole 25 is larger than the dimension of the rotation stopping portion 12 in the lateral direction.

The terminal body 21 is formed with left and right resilient contact pieces 27 that are cantilevered down below the terminal body 21 from left and right sides 26S of the opening edge of the rotation stopping hole 25. Each resilient contact piece 27 includes a substantially semicircular bent portion 28 connected to the side edge 26S and a substantially flat contact plate 29 cantilevered laterally out in a direction away from the rotation stopping hole 25 in a plan view from the extending lower edge of the bent portion 28. The upper surface of an upper end part of the bent portion 28 and an upper surface 21A of the terminal body 21 are connected tangentially in a view of the side surface 13S. The lower surface of a lower end part of the bent portion 28 and a lower surface 29A of the contact plate 29 also are connected tangentially in a view of the side surface 13S.

The resilient contact piece 27 is located entirely below the upper surface 21A of the terminal body 21 both in a state where the ground terminal fitting 20 is connected to the ground surface 10 and in a state where the ground terminal fitting 20 is not connected to the ground surface 10. The seating surface 16 of the nut 15 is brought into contact with the upper surface 21A of the terminal body 21. The lower surface 29A of the contact plate 29 is brought into contact with the ground surface 10A. The lower surface 29A of the contact plate 29 has front and rear projections 30. Each projection 30 has a substantially conical shape with a downward facing tip.

In a state where the ground terminal fitting 20 is not mounted on the stud bolt 11 (i.e. in a state where the resilient contact pieces 27 are not resiliently deformed), a minimum interval in the lateral direction between the pair of resilient contact pieces 27, as defined by the bent portions 28, is smaller than the dimension of the rotation stopping portion 12 in the lateral direction. In the state where the ground terminal fitting 20 is not connected to the ground surface 10A (i.e. in the state where the resilient contact pieces 27 are not resiliently deformed), a vertical dimension between the upper surface 21A of the terminal body 21 and the lower surfaces 29A of the contact plates 29 exceeds the height of the rotation stopping portion 12.

Next, the procedure of connecting the ground terminal fitting 20 to the ground surface 10A is described. Before the nut 15 is screwed onto the stud bolt 11, the rotation stopping hole 25 of the ground terminal fitting 20 is passed over the externally threaded portion 14 of the stud bolt 11 and is fit to the rotation stopping portion 12. At this time, the ground terminal fitting 20 is positioned so that the front and rear edges 26F, 26R of the rotation stopping hole 25 are brought into contact respectively with the front and rear surfaces 13F, 13R of the rotation stopping portion 12 and the left and right resilient contact pieces 27 correspond to the left and right side surfaces 13S of the rotation stopping portion 12.

In the process of fitting the ground terminal fitting 20 to the rotation stopping portion 12, the bent portions 28 of the resilient contact pieces 27 contact the rotation stopping portion 12. If the ground terminal fitting 20 is connected further from this state, the resilient contact pieces 27 are deformed resiliently to widen an interval therebetween and the left and right bent portions 28 resiliently slide in contact with the left and right side surfaces 13S of the rotation stopping portion 12. The projections 30 of the left and right contact plates 29 then contact the upper surface 10A of the ground 10. In this state, the upper surface 21A of the terminal body 21 is located above the upper surface 12A of the rotation stopping portion 12.

The nut 15 is screwed onto the externally threaded portion 14 from this state. In the screwing process, the seating surface 16 of the nut 15 presses the upper surface 21A of the terminal body 21 while being held in surface contact therewith. When the nut 15 is screwed further from this state, the terminal body 21 is displaced down to approach the upper surface 10A of the ground 10 and the resilient contact pieces 27 are deformed resiliently to bring the contact plates 29 thereof closer to the terminal body 21. Further, as the resilient contact pieces 27 are deformed resiliently, the projections 30 bite into the upper surface 10A of the ground 10 due to resilient restoring forces of the resilient contact pieces 27. The connection of the ground terminal fitting 20 to the ground 10 is completed when the nut 15 is tightened until the seating surface 16 comes into surface contact with the upper surface 12A of the rotation stopping portion 12.

In the state where the ground terminal fitting 20 is connected to the ground 10, the lower surfaces 29A of the contact plates 29 are held resiliently in surface contact with the upper surface 10A of the ground 10 due to the resilient restoring forces of the resilient contact pieces 27. Thus, the terminal body 21 and the ground 10 become conductive via the resilient contact pieces 27. Likewise, the upper surface 21A of the terminal body 21 and the seating surface 16 of the nut 15 are held resiliently in surface contact due to the resilient restoring forces of the resilient contact pieces 27 so that the terminal body 21 and the ground surface 10 become conductive via the nut 15 and the stud bolt 11. Likewise, the bent portions 28 of the resilient contact pieces 27 are held resiliently in contact with both left and right side surfaces 13S of the rotation stopping portion 12 due to the resilient restoring forces of the resilient contact pieces 27. Hence, the terminal body 21 and the ground 10 become conductive via the resilient contact pieces 27 and the rotation stopping portion 12.

The ground connection structure of this embodiment includes the stud bolt 11 standing on the ground surface 10A, the non-circular rotation stopping portion 12 formed on the base part of the stud bolt 11 and the ground terminal fitting 20 to be connected conductively to the ground surface 10. The ground terminal fitting 20 is formed with the non-circular rotation stopping hole 25 to be fit to the rotation stopping portion 12 with relative rotation restricted. The resilient contact pieces 27 are cantilevered down from the edge of the rotation stopping hole 25 toward the ground 10 along an axial direction of the stud bolt 11. When the nut 15 is screwed onto the stud bolt 11, the resilient contact pieces 27 are deflected resiliently between the nut 15 and the ground surface 10.

According to this configuration, the resilient contact pieces 27 are deflected resiliently between the nut 15 and the ground surface 10 when the nut 15 is screwed onto the stud bolt 11. Thus, the ground terminal fitting 20 and the ground 10 reliably become connected conductively due to the resilient restoring forces of the resilient contact pieces 27. Further, the resilient contact pieces 27 are not formed by cutting and raising parts of the terminal body portion 21, but extend from the opening edge part of the rotation stopping hole 25, which is essential for the connection to the ground surface 10. Thus, the terminal body portion 21 need not have any other opening due to the formation of the resilient contact pieces 27. Thus, the strength of the terminal body 21 is not reduced due to the formation of the resilient contact pieces 27.

The resilient contact pieces 27 project only toward the ground surface 10 from the terminal body 21. Thus, the rotating nut 15 does not contact the resilient contact pieces 27 when being screwed onto the stud bolt 11, and the resilient contact pieces 27 will not be deformed improperly due to interference with the nut 15, friction or the like.

The projections 30 are formed on the lower surfaces 29A of the contact plates 29 of the resilient contact pieces 27 and bite into the upper surface 10A of the ground 10. According to this configuration, the reliability of connection between the ground terminal fitting 20 and the ground 10 is improved by the projections 30 biting into the upper surface 10A. Further, the resilient contact pieces 27 are held resiliently in contact with the outer periphery at left and right side surfaces 13S of the rotation stopping portion 12 so that a contact area of the ground terminal fitting 20 with the side of the ground surface 10 (stud bolt 11) is enlarged by contact areas of the resilient contact pieces 27 with the outer periphery of the rotation stopping portion 12. Thus, the reliability of grounding performance is improved.

The present invention is not limited to the above described embodiment. For example, the following embodiments are also included in the scope of the invention.

Although rotation is stopped by bringing two front and rear edges of the opening of the rotation stopping hole into contact with the rotation stopping portion in the above embodiment, the edges of the rotation stopping hole to be brought into contact with the rotation stopping portion may be other than those described above.

The outer periphery of the rotation stopping portion has a square shape with no arc in the above embodiment. However, the outer periphery of the rotation stopping portion may include an arc.

The resilient contact pieces are brought resiliently into contact with only the ground surface in the above embodiment. However, the resilient contact pieces may be brought resiliently into contact with only the nut or with both the nut and the ground. For example, one resilient contact piece may be brought into contact with both the nut and the ground, or the edge of the rotation stopping hole may have a first resilient contact piece to be brought resiliently into contact with only the nut and a second resilient contact piece to be brought resiliently into contact with only the ground surface.

Although the projections are formed on the resilient contact pieces in the above embodiment, the resilient contact pieces may include no projection.

Although the resilient contact pieces are brought into contact with the outer periphery of the rotation stopping portion in the above embodiment, the resilient contact pieces may be out of contact with the outer periphery of the rotation stopping portion.

Although the two resilient contact pieces are bilaterally symmetrical in the above embodiment, the resilient contact pieces may be bilaterally asymmetrical.

Although two resilient contact pieces are formed around one rotation stopping hole in the above embodiment, the number of the resilient contact pieces formed around one rotation stopping hole may be one, three or more.

LIST OF REFERENCE SIGNS

10 . . . ground
11 . . . stud bolt
12 . . . rotation stopping portion
13S . . . side surface (outer periphery of rotation stopping portion)
15 . . . nut
20 . . . ground terminal fitting
25 . . . rotation stopping hole
27 . . . resilient contact piece
30 . . . projection

What is claimed is:

1. A ground connection structure, comprising:
a stud bolt standing on a surface of a ground;
a non-circular rotation stopping portion formed on a base part of the stud bolt;
a ground terminal fitting to be connected conductively to the ground;
a non-circular rotation stopping hole formed in the ground terminal; fitting and fit to the rotation stopping portion with relative rotation restricted;
at least one resilient contact piece extending from an edge of the rotation stopping hole; and
a nut screwed onto the stud bolt and configured to deflect the at least one resilient contact piece resiliently between the nut and the ground.

2. The ground connection structure of claim 1, wherein the at least one resilient contact piece projects only toward the surface of the ground.

3. The ground connection structure of claim 2, further comprising at least one projection formed in a contact area of the at least one resilient contact piece with the ground and configured to bite into the surface of the ground.

4. The ground connection structure of claim 1, wherein the at least one resilient contact piece is configured to resiliently contact an outer periphery of the rotation stopping portion.

5. The ground connection structure of claim 1, wherein the at least one resilient contact piece comprises two resilient contact pieces extending from opposite edges of the rotation stopping hole.

6. The ground connection structure of claim 5, wherein the ground terminal fitting has a terminal body, the rotation stopping hole being formed in the terminal body, the resilient contact pieces are bent to lie between the terminal body and the ground.

7. The ground connection structure of claim 6, wherein each of the resilient contact pieces has a curve bent from the terminal body and a contact plate aligned substantially parallel to the terminal body.

8. The ground connection structure of claim 6, wherein the rotation stopping hole is square with two opposite side edges from which the resilient contact pieces extend, and opposite front and rear edges that engage opposite front and rear edges of the rotation stopping portion.

9. A ground terminal fitting conductively connectable to a surface of a ground on which a stud bolt stands, a base part of the stud bolt having a non-circular rotation stopping portion supported on the surface of the ground, the ground terminal fitting comprising:

a terminal body in the form of a flat plate, a non-circular rotation stopping hole formed in the terminal body and configured to be fitted to the non-circular rotation stopping portion formed on the base part of the stud bolt with relative rotation restricted; and at least one resilient contact piece extending from an edge of the terminal body in the rotation stopping hole, the resilient contact piece including a substantially semi-circular bent portion connected to the edge of the terminal body in the rotation stopping hole and a substantially flat contact plate cantilevered laterally out from an end of the semicircular bent portion to extend away from the rotation stopping hole, the at least one resilient contact piece being resiliently deflected between a nut screwed onto the stud bolt and the ground.

10. The ground terminal fitting of claim 9, further comprising at least one projection formed on the contact plate of the at least one resilient contact piece and configured to bite into the surface of the ground.

11. The ground terminal fitting of claim 9, wherein the at least one resilient contact piece is configured to resiliently contact an outer periphery of the rotation stopping portion.

12. The ground terminal fitting of claim 9, wherein the at least one resilient contact piece comprises two resilient contact pieces extending from opposite edges of the rotation stopping hole.

* * * * *